United States Patent [19]

Chou et al.

[11] Patent Number: 4,822,643

[45] Date of Patent: Apr. 18, 1989

[54] THERMAL TRANSFER IMAGING SYSTEM

[75] Inventors: Hsin-Hsin Chou; Mohamed A. Elmasry, both of Woodbury; Jeffrey C. Chang, North Oaks; Kevin M. Kidnie, St. Paul, all of Minn.

[73] Assignee: Minnesota Mining and Manufacturing Company, St. Paul, Minn.

[21] Appl. No.: 68,648

[22] Filed: Jun. 30, 1987

[51] Int. Cl.[4] ..... B41M 5/26

[52] U.S. Cl. ..... 427/256; 156/234; 427/148; 428/195; 428/207; 428/216; 428/327; 428/484; 428/913; 428/914; 428/337

[58] Field of Search ..... 428/484, 488.1, 488.4, 428/913, 914, 216, 327, 195, 207, 323, 337; 427/148, 256; 156/234

[56] References Cited

U.S. PATENT DOCUMENTS

| | | | |
|---|---|---|---|
| 3,218,302 | 11/1965 | Melamed et al. | 260/80 |
| 3,753,760 | 8/1973 | Kesel | 117/37 |
| 3,985,700 | 10/1976 | Nicks et al. | 260/33.6 R |
| 3,991,226 | 11/1976 | Kesel | 427/17 |
| 4,388,387 | 6/1983 | Masayoshi | 430/7 |
| 4,470,714 | 9/1984 | Aviram et al. | 400/241.1 |
| 4,474,859 | 10/1984 | Oshima et al. | 428/431 |
| 4,476,210 | 10/1984 | Croucher et al. | 430/114 |
| 4,490,435 | 12/1984 | Oshima et al. | 428/341 |
| 4,491,432 | 1/1985 | Aviram et al. | 400/241.1 |
| 4,541,042 | 9/1985 | Kohashi | 346/76 |
| 4,549,824 | 10/1985 | Sachdev et al. | 400/241.1 |
| 4,588,315 | 5/1986 | Seto et al. | 400/120 |

FOREIGN PATENT DOCUMENTS

| | | | |
|---|---|---|---|
| 0111004 | 6/1984 | European Pat. Off. . | |
| 0163297 | 12/1985 | European Pat. Off. . | |
| 185191 | 11/1982 | Japan | 428/488.1 |

OTHER PUBLICATIONS

Oki Technical Review 123; Jan. 1986; Development of 16 Dot/mm Resolution Thermal Printing Head by S. Shibata et al; 8 pages (51–58).

*Primary Examiner*—Ellis P. Robinson
*Assistant Examiner*—P. R. Schwartz
*Attorney, Agent, or Firm*—Donald M. Sell; Walter N. Kirn; Mark A. Litman

[57] ABSTRACT

A thermal imaging transfer process and donor sheet are described. The donor sheet comprises a layer of particulate colorant/binder on a substrate. Essentially individual particles are transferred during imaging to provide a high resolution image.

18 Claims, No Drawings

THERMAL TRANSFER IMAGING SYSTEM

BACKGROUND OF THE INVENTION

1. Field of the Invention

The present invention relates to thermal image transfer systems, to donor sheets useful in such systems, and to processes for thermally transferring images.

2. Background of the Art

Many imaging systems have been developed to be used with computer generated and other electronically generated images. This development has been necessitated by the generation or transmission of electronic images and the need for hard copy prints, both in black-and-white and color. Originally silver halide imaging systems were used for such imaging generation, and such systems still can provide high quality images. In certain areas of the market, lower image quality can be tolerated and lower costs are essential. Ink-jet printing and thermal dye transfer systems have found increasing acceptance in these markets.

Ink-jet printing has suffered in its acceptance because of a number of technical problems, not the least of which is a tendency of the print heads to clog. This requires an intolerable level of maintenance and a complete shut down of the system during servicing. Furthermore, image colors tended to be unstable and color gradation was virtually non-existent. Thermal colorant transfer systems have had fewer maintenance problems, but again image colors have not been stable where dyes are used as the colorant. Color gradation has also been quite limited in commercial systems, although significant improvements in these problems have been made in thermal colorant transfer systems.

The technology of thermal colorant transfer systems can generally be divided into two fields, mass transfer and dye sublimation transfer. The term mass transfer is used to refer to systems in which both the colorant and its binder are transferred from a donor sheet to a receptor sheet (or intermediate carrier sheet). Because of the relatively large size of the transferred material, a particle comprising both colorant and binder, color gradation or continuous tones in the image is difficult to achieve. Furthermore, if the colorant is a dye it exhibits more limited aging stability than do pigments.

The term dye sublimation transfer is used to refer to systems in which essentially only the colorant is transferred by sublimation or vaporization to a receptor sheet. This type of process would leave behind in the donor sheet any binder which might have been used in the donor sheet. This molecular transfer of colorant is capable of producing excellent continuous tone images because of the extremely small size of dye particles which can be transferred to the receptor sheet. There are two well defined problems with dye sublimation transfer systems, however. High energy levels (at least 6 Joules/cm$^2$) are needed to transfer the dye. This results in both low output rates and excessive wear on the print head. Secondly, since the use of dyes is inherent in a sublimation or vaporization process, some image colors are unstable. To correct this problem, some dye sublimation transfer systems laminate a protective cover sheet to the color print image.

Various attempts have been made to eliminate or reduce the limitations described above. In the mass transfer area for example much of the improvement has occurred in the design and thermal control of the print head. A good example of this approch is given by S. Maruno of Matsushita Elec. Inc. Co., Ltd. in a paper presented at the August '86 SPSE Conference on Non-impact Printing Technologies in San Francisco. He described "thermo-convergent ink transfer printing" (TCIP) as a system in which the shape of the heating elements of the print head are optimized and the energy pulses to the head are controlled so that continuous tone reproduction is much improved when wax-colorant donor sheets are used.

Understandably the donor sheet itself has been the target of improvement work in recent years. Japanese Kokai No., J59224394 discloses the use of two incompatible binders in which the dye is dissolved. This results in the mass transfer of relatively small particles of colorant. Combining this donor sheet with good print-head control is reported to give some low level of color gradation.

European patent, EPO No. 163,297 teaches the use of high melting-point particles with diameters larger than the thickness of the ink layer which particles serve as heat conductors to aid in the transfer of the colorant mass.

A paper by Tagushi et al. of Matsushita given at the SPSE conference, August '86, in San Francisco briefly described a system claimed to yield improved mass transfer quality. This system makes use of one resin and colorant in the donor sheet and a different resin in the receptor sheet. The modulated thermal signal in the print-head causes changes in the "melt, compatibility, adhesion and transfer between the two resins" thus producing a continually graduated print.

In an effort to speed up the thermal mass transfer of wax/colorant systems, U.S. Pat. No. 4,541,043 describes an apparatus and method which makes possible the application of a solvent to the interface formed by the donor and receiving sheets.

Other examples of improved thermal mass transfer systems include: (a) donor sheets incorporating conductive/resistive layer pairs in their constructions as described in U.S. Pat. Nos. 4,470,714 and 4,588,315; and (b) donor sheets containing exothermic materials to amplify the energy provided by the print-head as taught in U.S. Pat. Nos. 4,491,432 and 4,549,824.

In the area of dye sublimation transfer, many attempts have been made to overcome the limitations of the system. The use of low molecular weight/melting point dyes has lowered the required transfer energy to some extent but this still remains higher than conventional commercial thermal print-head operating levels. Furthermore dyes of low melting-point tend to reduce image stability. Other changes in the area of dye sublimation include the use of binders in the receptor sheet which have an affinity for the vaporized or sublimed dye as taught in U.S. Pat. Nos. 4,490,435, 4,474,859 and 4,388,387.

EPO No. 011,004 discloses the use of a non-sublimable, crosslinked binder in which a sublimable dye is dispersed.

Although most or all of these attempts have been successful to some extent, none has given the desired combination of low transfer energy and full color, continuous tone images of excellent image color stability.

SUMMARY OF THE INVENTION

The present invention describes a thermal colorant transfer system which reduces the major limitations of the thermal mass/dye transfer and dye sublimation transfer systems; namely low levels of color gradation, poor dye image color stability and high thermal energy requirements. This is accomplished by constructing a donor sheet consisting of colorant/polymer particles of sub-micron size coated on a substrate in such a way as to maintain the cohesive forces between particles relatively low as compared to conventional thermal transfer systems.

The coating medium consists of a dispersion of sub-micron size, colored polymer particles in a suitable dispersion medium. The liquid phase of the dispersion may be an organic or an aqueous liquid depending on the requirements of the coating method to be employed in preparing the donor sheet. The colorant may be a pigment, a dye, or a polymeric dye or any combination of the three. The polymers used in the particles are prepared by known techniques such as: (1) free radical polymerization of ethylenically unsaturated monomers in a suitable liquid; (2) polycondensation of a diacid and a diol in a suitable non-aqueous medium.

Thermal colorant transfer donor sheets prepared according to this invention exhibit several advantages over wax/dye systems in that they yield color images of superior quality, transparency, color gradation, and abrasion resistance. Compared to dye "sublimation" systems the present invention requires less transfer energy and gives a more stable image.

DETAILED DESCRIPTION OF THE INVENTION

The thermal colorant transfer system of this invention makes possible several improvements over conventional thermal mass/dye and "sublimation" transfer methods. It approaches the continuous tone quality of "sublimation" copy but requires far less transfer energy. Furthermore the present system yields color images of superior transparency, color gradation, stability and abrasion or wear resistance as compared to conventional mass/dye transfer systems.

The thermal colorant transfer system of the present invention can be used with commercially available thermal printing systems. These systems function by first providing a donor sheet comprising a carrier layer and a thermally transferable medium which provides the optical density in the imaged areas. A printing head comprised of a small heating element or a number of very small heating elements is brought into contact with the backside of the donor sheet. Localized heating of the backside of the donor sheet by the heating elements causes thermal transfer of the medium to a receptor sheet. Usually the medium is melted so that it will release from the carrier layer of the donor sheet and transfer to the receptor layer. The printing heads may move linearly across a sheet or there may be a line printing head having a number of individual heads distributed across it which moves across an entire surface of a donor sheet.

The donor recording sheet as its name implies functions as the heat sensitive carrier for the colorant. It consists essentially of a substrate coated with a continuous coating of colorant/polymer particles as taught in the present invention. The substrate can be any thin material (less than 12 microns, preferably less than 10 microns) which has suitable heat transfer characteristics as known in the art and which exhibits the thermal dimensional stability required by the relatively high thermal head temperature. Examples of these substrates are films made of polyester, polyimide and cellophane as well as condenser paper. The backside of the film, i.e., the surface which comes in contact with the thermal print-head can be treated with anti-stick materials as described in U.S. Pat. Nos. 4,541,830 and can include in its cross-section acicular or other heat transfer materials which render the heat conductivity of the substrate anisotropic thus minimizing image spread and improving image sharpness.

The coating medium consists of colorant/polymer particles dispersed in a suitable liquid.

The colorant may be a pigment, a stable dye, a polymeric dye or any combination of these. It may be physically absorbed in the polymer as is the case when a dye is used, or it may physically adsorb to the polymer, e.g., when a pigment is used or it may be chemically bound to the polymer as in the case of a polymeric dye as described in U.S. Pat. Nos. 3,753,760; 3,900,412 and 3,991,226.

The liquid phase of the dispersion may be an organic or an aqueous liquid depending on the type of polymer dispersion and on the coating method to be used for making the donor sheet.

(1) In a non-aqueous dispersion the medium can be:

(A) a high boiling, insulating liquid such as Isopar G (an isoparafin);

(B) a low boiling liquid such as heptane or petroleum ether.

(2) Water with appropriate dispersants is employed for aqueous dispersions.

Type 1A dispersing liquids are used when electrophoresis, a preferred method of coating the donor sheet, is employed. Liquids of Type 1B are used for more conventional methods, such as knife coating. Aqueous dispersions are employed when environmental considerations are paramount.

Table I below lists some of the important considerations involved in these colorant/polymer dispersions.

TABLE I

| Type of Polymerization | Continuous Phase | Solubility of Initiator in Continuous Phase | Stabilizing Component/ Solubility in Continuous Phase | Solubility of Core Monomer In Continuous Phase |
|---|---|---|---|---|
| (1) Emulsion or Dispersion | Water | Soluble | Electrostatically-stabilized with ionic surfactant/soluble | Low Solubility |
| (2) Suspension | Water | Not Soluble but soluble in the monomer | Same as above | Soluble |
| (3) Dispersion | Organic Liquid | Soluble | Sterically stabilized with amphiphatic graft or block copolymer/soluble in continuous phase | Soluble |

Dispersion polymerization (Number 3 in Table I) in organic liquids usually involves the polymerization of a monomer dissolved in an organic diluent to produce an insoluble polymer dispersed in the continuous phase in the presence of an amphipathic graft or block copolymer (called steric stabilizer) as the dispersant. The steric stabilizer consists mainly of two polymeric components, so that one polymeric moiety is soluble and another component is insoluble in the continuous phase. The soluble component constitutes the major proportion of the stabilizer. Its function is to provide a lyophilic layer completely covering the surface of the particle. It is responsible for the stabilization of the dispersion against flocculation. The insoluble component which represents the minor proportion of the dispersant consists of anchoring groups. The function of these groups is to provide a covalent-link between the core part of the dispersed particle and the soluble component of the stabilizer. Strong anchoring of the solvated moiety to the surface of the particle is essential to prevent either disruption from the surface or displacement during particle collision. Among the methods employed for anchoring by covalent links is the random grafting of nonsolvated polymeric moieties onto the saturated backbone of the soluble polymer, through a free radical initiator such as benzoylperoxide. The function of the initiator is to generate reactive sites on the soluble polymer molecule by hydrogen abstraction which subsequently initiates the polymerization of the grafting monomer at these newly formed reactive sites. In this method all polymers take part in such reactions to some extent. Numerous reactions have been employed for the attachment of reactive unsaturated monomers to a soluble polymer containing reactive groups. Examples of reactive monomers are listed in Table II below under columns A and B. Either of the compounds listed may be used as the grafting component.

TABLE II

| A | B | Reaction Conditions | Catalyst |
|---|---|---|---|
| Glycidyl methacrylate (GMA) | Methacrylic acid<br>Allylamine<br>Maleic acid<br>Crotonic acid<br>Maleic anhydride | 100–150°<br>12 hours<br>80–100° | tertiary amine<br>cordova amine |
| Methacryloyl chloride | 2-Hydroxyethyl methacrylate<br>allylamine | 90–100° | tertiary amine |
| isocyanatoethyl-methacrylate | Hydroxyethyl methacrylate,<br>allylamine | | dibutyltin dilaurate |

The graft copolymer stabilizer precursor is prepared by the polymerization of comonomers of unsaturated fatty esters and a monomer of columns A or B, Table II, in aliphatic hydrocarbons in the presence of free radical polymerization initiator. When polymerization is terminated, the resulting precursor stabilizer is further reacted with the corresponding grafting monomer of columns A or B.

The latex is prepared by free radical polymerization of the graft copolymer stabilizer and a monomer of (meth)acrylic ester in aliphatic hydrocarbon diluent in the presence of an azo or peroxide initiator to produce an opaque white latex.

Examples of useful unsaturated fatty esters: octadecyl methacrylate, 2-ethylhexylacrylate, poly(1,2-hydroxy steric acid/glycidylmethacrylate), and lauryl methacrylate.

Different properties of the materials and the particles and their components may of course be varied to improve the performance of the system.

The glass transition temperature ($T_g$) of the core part of the polymer particles, the steric stabilizer/core ratio, and the pigment/polymer particles ratio may be chosen so that a low energy transfer is achieved. The preferred $T_g$ of the core may be in the range of 10° C.–55° C. However, latices with $T_g$'s outside of that range may be useful provided a polymeric additive is included in the dispersion composition which effectively reduces the $T_g$. For example, when it is desirable to use a latex with a $T_g > 55°$ C., the $T_g$ of the polymeric additive must be lower than 55° C. On the other hand if the $T_g$ of the latex of choice is less than 10° C., the $T_g$ of the polymeric additive should be $> 10°$ C. Effective Tg means that if the latex composition (i.e., latex plus additives) is measured for its Tg, an apparent Tg will be measured for the composition which may be different from that of the latex alone. The measured Tg for the composition is the effective Tg. For example, two polymers having individual Tg's outside the preferred range (−5° C. and +60° C.) may be proportionally combined to provide an effective Tg between 10° C. and 55° C. The measured effective Tg may even display two peaks outside this range, but the mixture effectively acts if the Tg were within the range. It is of course important to remember that the coating layer remains in a form wherein particles of the colorant/polymer are provided on the surface of the donor sheet rather than merely a polymer film containing colorant.

The colorant/polymer particles are preferably essentially monodispersed by which we mean that they are generally about the same size and shape having a relatively narrow size distribution. The nonaqueous dispersion polymerization process (Number 3 of Table I) by which the particles are made provides for a well controlled particle size distribution. Typically the size of the particle is of the order of about 0.4 microns although the size range may be as broad as 0.1 to 1.0 microns as determined from transmission electron micrographs and using a Coulter Nanosizer. In the case of electrophoretic coating, the monodispersed nature is preferred in providing substantially uniform charge on each particle or uniform charge to mass ratio of the dispersion and thereby insuring more accurate response of the charged colorant/polymer particles to the biased voltage needed for disposition.

Any suitable thermoplastic resin may be used as the core of the colorant/polymer particle. Typical resins include materials which are capable of nonaqueous dispersion polymerization as hereinafter described, are insoluble in the dispersion medium, and include poly(methyl acrylate), poly(methyl methacrylate), poly(ethyl, methacrylate), poly(hydroxyethyl methacrylate), poly(2-ethoxyethyl methacrylate), poly(butoxy ethoxy ethyl methacrylate), poly(dimethyl amino ethyl methacrylate), poly(acrylic acid), poly(methacrylic acid), poly(acrylamide), poly(methacrylamide), poly(acrylonitrile), poly(vinyl chloride) and poly(ureido-ethyl vinyl ether). A preferred group of materials are the homopolymers of vinyl acetate, N-vinyl-2-pyrrolidone, ethyl acrylate monomers or copolymers of any of said monomers. The mechanical properties of the particle can be altered or varied by the selection of the polymer used for the core of the particle. For example, using poly(vinyl pyrrolidone) as the core polymer gives a hard particle which retains its spherical shape on drying. On the other hand poly(ethyl acrylate) particles coalesce on drying to form a film. This choice of polymeric materials enables control of the thermomechanical properties that are essential for thermal transfer.

The amphipathic stabilizer which is irreversibly anchored to the synthetic resin core may be of any suitable material. Amphipathic means the material has some solubility and/or compatibility with both polar and nonpolar solvents. This is usually accomplished by having moieties with different properties on various portions of the material. A typical material would have at least one polar group or segment and at least one nonpolar group or segment on the molecule. Typically it involves a graft or block copolymer having a moiety with an affinity for or being solvated by the dispersion medium and having methyl moiety having an affinity for the synthetic resin core. Preferably the amphipathic stabilizer has a molecular weight in the range of from about 10,000 to about 100,000. Lower molecular weights, i.e., less than about 10,000 generally provide an insufficient steric barrier for the core particles which will still tend to flocculate while molecular weights above about 100,000 are usually unnecessary and uneconomical. Preferably the amphipathic polymer comprises a soluble polymer backbone having a nominally insoluble anchoring chain grafted onto the backbone. Alternatively the steric stabilizer may comprise an AB or ABA type block copolymer. Typical block copolymers include, poly(vinyl acetate-b-dimethyl siloxane), poly(styrene-b-dimethyl siloxane), poly(methyl methacrylate-b-dimethylsiloxane), poly(vinyl acetate-b-isobutylene), poly(vinyl acetate-b-2-ethyl hexyl methacrylate), poly(styrene-b-2-ethyl hexyl methacrylate), poly(ethyl methacrylate-b-2-ethyl hexyl methacrylate), and poly(dimethylsiloxane-styrene-dimethylsiloxane).

Typical polymers suggested for use as the soluble backbone portion of the graft copolymer upon which a second polymer may be grafted include polyisobutylene; polydimethylsiloxane; poly(vinyl toluene); poly(12-hydroxy stearic acid); poly(iso bornyl methacrylate); acrylic and methacrylic polymers of long chain esters of acrylic an methacrylic acid such as stearyl, lauryl, octyl, hexyl, 2-ethyl hexyl; polymeric vinyl esters of long chain acids such as vinyl stearate; vinyl laurate; vinyl palmitate; polymeric vinyl alkyl ethers including poly(vinyl ethyl ether); poly(vinyl isopropyl ether); poly(vinyl isobutyl ether); poly(vinyl n-butyl ether); and copolymers of the above.

Preferred backbone polymers include polyisobutylene, poly(2-ethylhexyl acrylate), poly(2-ethylhexyl methacrylate).

Typical monomers suggested for use as the insoluble portion of the graft copolymer include vinyl acetate, methyl acrylate, methyl methacrylate, ethyl acrylate, ethyl methacrylate, hydroxy ethyl acrylate, hydroxy ethyl methacrylate, acrylonitrile, acrylamide, methacrylonitrile, methacrylamide, acrylic acid, methacrylic acid, mono-ethyl maleate, monoethyl fumarate, styrene, maleic anhydride, maleic acid and N-vinyl-2-pyrrolidone. Preferred materials include vinyl acetate, N-vinyl-2-pyrrolidone and ethyl acrylate, because they are nontoxic, inexpensive and readily grafted onto a variety of soluble backbone polymers and provide excellent anchoring to the core particle. While as noted above the synthetic resin core must be insoluble in the dispersion liquid the backbone moiety of the amphipathic stabilizer is soluble in the dispersion liquid and imparts colloidal stability to the particle.

The polymer particle may employ any suitable colorant to impart color to it. Colorant include pigments, stable dyes, and polymeric dyes. The colorant is preferably dispersible at the submicron or even molecular level in the synthetic resin core to provide a sub-micron dispersion and insure good distribution since otherwise it will tend to aggregate and give poor color intensity as well as broadened spectral characteristics. Furthermore it is preferred that the dye, if it is the colorant of choice, be water insoluble to insure permanence of the final image. Otherwise following thermal transfer to the receptor, if it were to come in contact with water as may frequently be the case in an office environment with coffee, tea, etc., the image would instantaneously dissolve. Typical dyes that may be used include Orasol Blue GN, Orasol Red 2BL, Orasol Blue BLN, Orasol Black CN, Orasol Yellow 2RLN, Orasol Red 2B, Orasol Blue 2GLN, Orasol Yellow 2GLN, Orasol Red G, available from Ciba Geigy, Mississauga, Ontario, Canada, Morfast Blue 100, Morfast Red 101, Morfast Red 104, Morfast Yellow 102, Morfast Black 101 available from Morton Chemicals Ltd., Ajax, Ontario, Canada and Savinyl Yellow RLS, Savinyl Pink 6BLS, Savinyl Red 21BLS, Savinyl Red GL5 available from Sandoz, Mississauga, Ontario, Canada.

The preferred steric stabilizer concentration in the dispersed polymer particles is in the range of 3–30%. However for polymeric particles with a core $T_g > 55°$ C. the steric stabilizer concentration may be increased up to 70%.

The ratio of colorant to binder must be within the range of 10:1 to 1:10 in weight proportions. Preferably the range of 4:1 to 1:5 and more preferably is within the range of 3:1 to 1:4 weight proportions. As the relative amount of colorant is increased, the colorant/binder particles tend to be too powdery and lose their bonding strength upon transfer. At the higher ratios of colorant to binder, the particles may tend to form a true continuous film without any retention of the particle-to-particle bonded network found in the donor sheet transfer media of the present invention.

This particle-to-particle network is an important characteristic of the thermal transfer media. The fact that the particles maintain at least a portion of their particulate appearance enables essentially individual particles to be removed from the donor layer. This provides much more consistency in thermal transfer processes than does the transferral of a patch out of a continuous film. This process and donor medium allows the particles to be thermally transferred at an applied energy level of 4 Joules/cm$^2$ or less, usually in the range of 0.7–4.0 Joules/cm$^2$.

These dispersed polymer particles are prepared by known techniques such as free radical polymerization and polycondensation, Examples of these are (1) free radical polymerization of ethylenically unsaturated monomers in a suitable liquid; (2) polycondensation of a diacid and a diol in a suitable non-aqueous medium as described in U.S. Pat. No. 3,985,700.

The size of the colorant/polymer particles used in the thermally transferable media of the present invention is important. The invidual particles must be less than 1 micron, preferably between 0.1 and 0.6 microns, and most preferably between 0.15 and 0.5 microns or between 0.2 and 0.4 microns.

The particles after being deposited on the surface of the donor sheet form a layer in which they are held together by moderate adhesive forces. The relatively low level of these forces allows excellent thermal transfer of the particles to a receptor sheet using low energy transfer heads. Although the layer of colorant/polymer particles gives the appearance of a continuous film to the naked eye, it is essentially particulate in nature as revealed when viewed under a microscope (at 10,000× magnification). The particles are transferred during imaging by adhesive transfer from the donor sheet to the receptor sheet. For higher binder/colorant ratio donor sheets, upon being softened by the energy transmitted to the donor sheet from the printing heads, the particle more strongly adheres to the receptor sheet and is removed from contact with the donor sheet upon separation of the donor and receptor sheets after thermal imaging. For lower binder/colorant ratio donor sheets a low Tg thermoplastic receptor surface is needed for optimum transfer. It is in part because only a softening or melting of these small particles (or receptor surface as noted above) is necessary to effect imaging that relatively low energy levels are needed to form continuous tone images in the process as compared to sublimation transfer systems.

The materials produced in the following preparations were used in the Examples which appear in this patent.

PREPARATION OF STERIC STABILIZER (SSA)

In a 500ml, 2-necked flask fitted with a thermometer, and a reflux condenser connected to a $N_2$ source, introduce a mixture of 225g of petroleum ether (b.p. 90–120° C.), 95g of lauryl methacrylate, 2g of methacrylic acid and 3g of vinylpyridine. The solution is heated at 75° C. for a few minutes and then purged with N2. 1g of azobisisobutyronitrile (AlBN) is then added to this solution and the temperature is maintained at 75° C. for 8 hours. Next, the temperature is raised and the polymer solution is refluxed for ½ hour. Then 25mg hydroquinone, 3g of glycidyl methacrylate and 0.3g of lauryldimethylamine are added and refluxing continued under nitrogen blanket for 15 hours. A drop in the acid value indicated that about 48% of the glycidyl rings have been esterified.

PREPARATION OF STERIC STABILIZER SSAA

Using the same apparatus as described in the preparation of SSA, a mixture of 97g of laurylmethacrylate, 3g glycidylmethacrylate and 200g of isopar G is heated at 75° C. and the flask is purged with $N_2$ for few minutes. 1g of AlBN is then added and the polymerization is allowed to proceed at 75° C. under a blanket of $N_2$ for 8 hours while stirring. Next, the temperature is raised and maintained at 110° C. for 1 hour to destroy unchanged initiator. The solution is cooled to 80° C. and a mixture of 220mg Cordova accelerator AmC-2 (Cordova Chemical Co. of Michigan, 500 Agard Rd. P.O. Box 51501), 2g of methacrylic acid and 20mg hydroquinone is added. The temperature is maintained at 80° C. for 8 hours. The resulting product is a viscous liquid which has a slight green color. A drop in the acid value indicates that about 50% of the glycidyl rings have been esterified.

POLYMER DISPERSIONS IN HEPTANE (a) Preparation of Polyvinylacetate Latex Using SSA. In a 5 liter 2-necked flask fitted with a thermometer and a reflux condenser connected to an $N_2$ source, introduce a mixture of SSA above, 210g of vinylacetate, 3g of AlBN and 2.5 liters of n-heptane. The flask is purged with $N_2$ and heated at 70° C. while stirring for 22 hours. A latex of $T_g$ 38° C. and particle size, 190nm plus or minus 55nm, is obtained. The solids content of the latex is adjusted to 15% w/w by the removal of heptane under reduced pressure corresponding to a conversion of 97.3%.

(b) Preparation of Polymethacrylate/methylmethacrylate Latex Using SSA. This latex is prepared as described above except using a mixture of 150g methylacrylate and 60g methylmethacrylate instead of vinylacetate. A polymer of $T_g$, 31.5° C. and particle diameter, 143nm plus or minus 27nm is obtained.

(c) Preparation of Polyethylacrylate Latex Using SSA. The above procedure was repeated except using 210g of ethylacrylate instead of vinylacetate. A white latex having a particle size of 120nm plus or minus 29nm and a $T_g$ of −12.5° C. is obtained.

(d) The above procedure and that for preparation of SSA were repeated except for using 3g of N-vinyl-2-pyrrolidone instead of vinylpyridine in the preparation of the steric stabilizer. (New SS was labeled SSB). The resulting latex had the same particle size and $T_g$ as were obtained in the procedure which produced the polyvinylacetate polymer dispersion.

(e) The above procedure was repeated except for using N,N-dimethylaminoethylmethacrylate instead of vinylpyridine. (New SS was labeled SSC). The resulting latex had the same particle size and $T_g$ as were obtained in the procedure which produced the polyvinylacetate polymer dispersion.

(f) The procedure for producing SSB was repeated except for using 2-ethylhexylmethacrylate instead of laurylmethacrylate in preparing the SS. (New SS was labeled SSD). Again the resulting latex had the same particle size and $T_g$ as obtained above.

GENERAL PROCEDURE FOR THE PREPARATION OF PIGMENT/LATEX INKS

A mixture of 300g of a latex with a solids content of 15% w/w, 15g of a pigment and 0.6g of a dispersing agent (surfactant) such as OLOA 1,200 (a polymer dispersion from California Chemical Co.) or Alkanol DOA (an amine polymer dispersion from E. I. DuPont Chem. Co.) is milled by known dispersion techniques for several hours. The most preferred device is the Silverson mixer. The temperature of the mixture is maintained below 60° C. to prevent solvent evaporation during the dispersion period. Between 4–6 hours of mechanical dispersion is sufficient to obtain a particle size in the range of 200nm–400nm.

Preferred pigments are listed below:

Sun fast magenta
Sun fast blue (cyan)
benzidine yellow
Quinacridone (magenta)
Carbon black (Raven 1250)

(All of the above are available as hydrocarbon dispersions from Sun Chemical Co.)

Red BR
Peacoline Blue 3G
Diarylide yellow (The last three are available in aqueous-based presscake form from Hilton-Davis Co.)

LATICES IN ISOPAR G

This section illustrates the preparation of latices for use in making donor sheets by electrophoretic deposition.

All procedures for the preparation of SSA and of the latex series were repeated except for using Isopar G as the dispersing medium instead of n-heptane. In addition the vinyl pyridine was eliminated from the SSA procedure and replaced with a mixture of 98g lauryl methacrylate and 2g of methacrylic acid.

The Isopar G-based latices of this series are designated by the letter G.

ELECTROSTATICALLY CHARGED PIGMENT/LATEX INKS

As mentioned earlier, one of the preferred methods of coating the donor sheets with colorant/latex is by electrophoretic deposition. For this method to be effective the latex particles must bear a charge. The procedure described below is for the preparation of charged colorant/latex inks. These inks employ the Isopar G parafin series of latices and the pigments described in the section above entitled "General Procedure for the Preparation of Pigment/Latex Inks". Stable dyes or polymeric dyes can be substituted for the pigments.

The polymer to pigment ratio is 3:1. To this mixture is added a charge control agent. The concentration of the charge control agent is in the range of 0.1–3% of the total solids with ~0.5% preferred. Useful charge control agents include metal soaps such as zirconium octoate, aluminum diisopropyl salicylate, calcium octoate and zinc, iron of naphthenic acid. The function of the charge control agent is to give the particle a charge for it to undergo electrophoresis in an electric field.

COLORANT/LATEX IN AQUEOUS MEDIUM

As a means of simplifying the dispersion procedure, speeding the coating process and reducing the environmental impact while retaining the desired particle characteristics a procedure for preparing a colorant/latex in aqueous medium is given below. The ink was prepared by dispersing a water-based latex, Wave 345 (wet adhesion vinyl emulsion, 50% w/w, $T_g$=22° C., available from Airproduct) with the cyan pigment (Peacoline Blue 3G Presscake, 46.6%, w/w, in water). The ratio of latex to pigment was adjusted to 1.5:1. Total solids in the ink dispersion is approximately 15%. The mixture was dispersed initially in a Silverson mixer and then in a Sonicator before coating. The donor sheet was prepared by coating the dispersion onto a 6 micron polyester film with a #10 Meyer bar and air dried. A 200 dot per inch experimental thermal printer was used for the transfer evaluation. A total mass transfer onto the plain 4 mil (0.1mm) polyester was observed at 3.3 Joules/cm$^2$ energy input. With the same energy input, gradation was observed to be ~10 levels from 32 levels input. By using a Scotch® White vinyl film as a receptor, the energy required for total mass transfer dropped to about 2.9 Joules/cm$^2$ and gradation was observed to be ~15 levels from 32 levels of input. The maximum optical density is 2.0.

The latex to pigment ratio was varied from 1:1 to 3:1. Best results was obtained at 1.5:1. Other aqueous latices such as Everflex MA ($T_g$=21° C.) were tried. Mass transfer at ~3.3 Joules/cm$^2$ with little gradiation was observed. It is speculated that good gradation would be obtained if the right latex to pigment ratio were achieved.

METHOD OF ELECTROPHORETIC DEPOSITION

This is the preferred method of preparing low energy transfer donor sheets. The discrete charged colorant-/latex particles are electrophoretically deposited on a 6 or 9 micron polyester film through a reverse bias potential on the developing head. During particle deposition, the substrate is in contact with a metal roller of plate to provide proper grounding. In this specific example the developing head is shaped like an extruding head with a colorant/latex injecting slot and an exhaust slot. A vacuum is pulled on the exhaust slot so that a continuous fresh dispersion stream is maintained between the flat developing electrode and the donor substrate which is kept during development at a higher potential with respect to the grounded roller or plate. The polarity of the voltage applied is the same as the polarity of the dispersed particles used. The optical density of the colorant depends on the voltage applied, the particle concentration, the dispersion conductivity and the developing speed. It can be easily adjusted so that a desired optical density is obtained.

TABLE III

RESULTS OF COATING TESTS*

| Latex Example | Latex $T_g$ (°C.) | Pigment | Pigment/ Latex | Dispersion Medium | Receptor | Transfer Energy (J/cm$^2$) | Grey Levels (32 input) |
|---|---|---|---|---|---|---|---|
| Polyvinyl Acetate | 38 | Sun Fast Magenta | 3:1 | Isopar G | 80/20 PET | 3.3 | 16–20 |
| | | Cyan (Sun Fast Blue) | 1:1 | | Epon 1001 coated PET | 2.0 | 16 |
| | | Benzidine Yellow (Sun Chemical) | 2:1 | | Oligomer/PVAc coated PET | 1.5 | 3–4 |
| | | | 1:3 | | PET | 2.5 | 10–15 |
| Polyvinyl Acetate | 38 | Sun Fast Magenta | 1:3 | Heptane | Scotchcal | 2.5 | 17 |
| | | Cyan (Sun Fast Blue) | | | | | |
| | | Benzidine Yellow (Sun Chemical) | | | Oligomer/Epon 1001 coated PET | 1.7 | ~10 |
| WAVE** | 22 | Cyan (Peacoline Blue) (Hilton-Davis) | 2:3 | Water | PET | 3.3 | 10 |
| | | | | | Scotchcal | 2.9 | ~15 |
| Ethylacrylate | −12.5 | Sun Fast Magenta (Sun Chemical) | 1:4 | Isopar G | PET | No Transfer | — |
| | | | | | Scotchcal | No Transfer | — |

*The thickness of the colorant ranges from ≦1μ for Isopar dispersion, ~1.5μ for Heptane dispersion to ~2μ for aqueous dispersion.
**WAVE Wet Adhesive Vinyl Emulsion; Air Product Company
PET Polyester film; 3 mils thick
PVAc Polyvinylacetate
Oligomer/PVAc 1:1 ratio of Oligomer (15% wt in Ethylacetate) solution to polyvinyl (10% wt in MEK) solution dry coating thickness 5μ
Scotchcal ® 3M Vinyl film

What is claimed is:

1. A process for the thermal transferring of images comprising the steps of:

(a) providing a thermal transfer donor sheet comprising a substrate having a front transfer surface and a back surface, said front surface comprising a layer of a dispersion of particles having average diameters of less than one micron, said particles being colored polymeric particles having a weight ratio of colorant to binder in said particles of between 10:1 and 1:10, said particles displaying an effective $T_g$ of less than or equal to 55° C., and said substrate having a thickness of less than 12 microns, (b) contacting said front surface with a receptor sheet, (c) applying an imagewise distribution of heat to the back surface of said sheet sufficient to locally soften said dispersion of particles and transfer said particles to said receptor sheet, and (d) separating said receptor sheet with an image thereon from said donor sheet.

2. The process of claim 1 wherein said particles display an effective Tg of between 10° and 50° C.

3. The process of claim 1 wherein said imagewise distribution of heat is applied at a level of less than 4 Joules/cm$^2$ to transfer said particles to said receptor sheet.

4. The process of claim 3 wherein the weight ratio of colorant to binder is between 4:1 and 1:5.

5. The process of claim 1 wherein said imagewise distribution of heat is applied at a level of between 0.7 and 4.0 Joules/cm$^2$ to transfer said particles to said receptor sheet.

6. The process of claim 1 wherein an essentially continuous tone image is transferred to said receptor sheet by transferring said particles.

7. A donor sheet for use in thermal transfer imaging processes comprising a carrier layer and a thermally tranferable medium layer, said carrier layer having a thickness of less than 12 microns and said thermally transferable medium layer comprising colored polymeric particles having an average diameter of less than one micron, said particles displaying an effective $T_g$ of less than or equal to 55° C., and wherein said colored polymeric particles comprise a mixture of colorant and polymeric binder in a weight rati of colorant to binder of between 10:1 and 1:10.

8. The donor sheet of claim 7 wherein said particles display an effective Tg of between 10° and 55° C.

9. The donor sheet of claim 7 wherein said colored polymeric particles comprise a mixture of colorant and polymeric binder in a weight ratio of colorant to binder of between 4:1 and 1:5.

10. The donor sheet of claim 9 wherein said carrier layer has a thickness of 10 microns or less.

11. The donor sheet of claim 7 wherein said colorant is a dye.

12. The donor sheet of claim 11 wherein said carrier layer has a thickness of 10 microns or less.

13. The donor sheet of claim 7 wherein said colorant is a pigment.

14. The donor sheet of claim 7 wherein said particle comprises a polymeric dye.

15. The donor sheet of claim 7 wherein said colored polymeric particles comprise a mixture of colorant and polymeric binder in a weight ratio of colorant to binder of between 4:1 and 1:5.

16. A donor sheet for use in thermal transfer imaging processes comprising a carrier layer and a thermally transferable medium layer, said carrier layer having a thickness of less than 12 microns and said thermally transferable medium layer comprising colored polymeric particles having an average diameter of less than one micron, said particles displaying an effective $T_g$ of less than or equal to 55° C., wherein said particles comprise a polymer dye, said polymeric dye having a colorant chemically bound to a polymer in a weight ratio of colorant to polymer of between 10:1 and 1:10.

17. The sheet of claim 16 wherein said particles are present as a dispersion.

18. A process for the thermal transferring of images comprising the steps of:

(a) providing a thermal transfer donor sheet comprising a substrate having a front transfer surface and a back surface, said front surface comprising a layer of particles having average diameters of less than one micron, said particles being colored polymeric particles comprising a polymeric dye, said particles displaying an effective $T_g$ of less than or equal to 55° C., wherein said colored polymeric particles comprise a mixture of colorant and polymeric binder in a weight ratio of colorant to binder of between 10:1 and 1:10, said said substrate having a thickness of less than 12 microns, (b) contacting said front surface with a receptor sheet, (c) applying an imagewise distribution of heat to the back surface of said sheet sufficient to locally soften said dispersion of particles and transfer said particles to said receptor sheet, and (d) separating said receptor sheet with an image thereon from said donor sheet.

* * * * *